US008943941B2

(12) United States Patent
Dow et al.

(10) Patent No.: US 8,943,941 B2
(45) Date of Patent: Feb. 3, 2015

(54) BRAIDED TUBE TO BRAIDED FLAT TO BRAIDED TUBE WITH REINFORCING MATERIAL

(71) Applicant: Triaxial Structures, Inc., Warminster, PA (US)

(72) Inventors: Richard M. Dow, Philadelphia, PA (US); Stephen J. Kryven, Langhorne, PA (US)

(73) Assignee: Triaxial Structures, Inc., Warminster, PA (US)

( * ) Notice: Subject to any disclaimer, the term of this patent is extended or adjusted under 35 U.S.C. 154(b) by 0 days.

(21) Appl. No.: 13/947,646

(22) Filed: Jul. 22, 2013

(65) Prior Publication Data

US 2014/0013931 A1 Jan. 16, 2014

Related U.S. Application Data

(63) Continuation-in-part of application No. 13/718,641, filed on Dec. 18, 2012, now Pat. No. 8,794,118, which is a continuation-in-part of application No. 13/034,053, filed on Feb. 24, 2011, now Pat. No. 8,347,772, which is a continuation-in-part of application No. 12/348,601, filed on Jan. 5, 2009, now Pat. No. 7,908,956.

(60) Provisional application No. 61/673,908, filed on Jul. 20, 2012, provisional application No. 61/368,417, filed on Jul. 28, 2010, provisional application No. 61/413,034, filed on Nov. 12, 2010, provisional application No. 61/019,694, filed on Jan. 8, 2008.

(51) Int. Cl.

| | |
|---|---|
| ***D04C 1/06*** | (2006.01) |
| ***D04C 3/00*** | (2006.01) |
| ***D04C 3/18*** | (2006.01) |
| ***D04C 3/24*** | (2006.01) |

(52) U.S. Cl.

CPC .. *D04C 3/00* (2013.01); *D04C 1/06* (2013.01); *D04C 3/18* (2013.01); *D04C 3/24* (2013.01); *D10B 2403/0333* (2013.01)

USPC ..... 87/11; 87/41

(58) Field of Classification Search

USPC ..... 87/7, 16, 41, 62, 11

See application file for complete search history.

(56) References Cited

U.S. PATENT DOCUMENTS

| | | | | | |
|---|---|---|---|---|---|
| 487,149 | A | * | 11/1892 | Krouse et al. | 2/338 |
| 1,032,870 | A | | 7/1912 | Wardell | |
| 1,423,587 | A | | 7/1922 | Wardell | |
| 2,148,164 | A | * | 2/1939 | Krippendorf | 87/37 |
| 2,879,687 | A | * | 3/1959 | Leimbach et al. | 87/37 |
| 3,714,861 | A | | 2/1973 | Maschinenfabrik | |
| 4,084,479 | A | | 4/1978 | Ratera | |
| 4,275,638 | A | | 6/1981 | DeYoung | |

(Continued)

*Primary Examiner* — Shaun R Hurley

(74) *Attorney, Agent, or Firm* — Duane Morris LLP; Steven E. Koffs

(57) ABSTRACT

A continuous braid structure has one or more first braid sections, each having a respective single flat braid or a respective single tubular braid. A plurality of second braid sections each have at least two flat braids with a gap between them. The second braid sections alternate with the one or more first braid sections. The adjacent first and second braid sections are continuous with each other. A length of material extends through the respective gap of at least one of the one or more second braid sections, so the length of material crosses one or more times between a first side of the continuous braid and a second side of the continuous braid.

21 Claims, 9 Drawing Sheets

(56) References Cited

U.S. PATENT DOCUMENTS

| | | | | |
|---|---|---|---|---|
| 4,700,054 | A | 10/1987 | Triplett | |
| 4,774,871 | A | 10/1988 | Jones et al. | |
| 4,943,334 | A | 7/1990 | Medney et al. | |
| 5,287,790 | A * | 2/1994 | Akiyama et al. | 87/9 |
| 5,361,674 | A | 11/1994 | Akiyama et al. | |
| 6,360,644 | B1 | 3/2002 | Bettger | |
| 6,599,561 | B2 | 7/2003 | Dow et al. | |
| 6,907,810 | B2 * | 6/2005 | Kim | 87/16 |
| 6,942,693 | B2 | 9/2005 | Chouinard et al. | |
| 7,004,967 | B2 | 2/2006 | Chouinard et al. | |
| 7,105,019 | B2 | 9/2006 | Hojeibane | |
| 7,237,466 | B2 | 7/2007 | Chen | |
| 7,270,043 | B2 | 9/2007 | Presz, Jr. et al. | |
| 7,908,956 | B2 * | 3/2011 | Dow et al. | 87/16 |
| 8,048,147 | B2 * | 11/2011 | Adams | 623/1.35 |
| 8,347,772 | B2 * | 1/2013 | Dow et al. | 87/41 |
| 2002/0055313 | A1 | 5/2002 | Velpari et al. | |
| 2004/0012937 | A1 | 1/2004 | DeGrappo et al. | |
| 2006/0225564 | A1 | 10/2006 | Presz, Jr. et al. | |
| 2007/0051232 | A1 | 3/2007 | Chen | |
| 2008/0216887 | A1 | 9/2008 | Hacke et al. | |
| 2009/0188380 | A1 * | 7/2009 | Dow et al. | 87/11 |
| 2011/0203446 | A1 * | 8/2011 | Dow et al. | 87/11 |

* cited by examiner

BRAIDED TUBE TO BRAIDED FLAT TO BRAIDED TUBE WITH REINFORCING MATERIAL

This application claims the benefit of U.S. Provisional Patent application No. 61/673,908, filed Jul. 20, 2012; and this application is a continuation in part of U.S. patent application Ser. No. 13/718,641, filed Dec. 18, 2012; which is a continuation in part of U.S. patent application Ser. No. 13/034,053, filed Feb. 24, 2011; now U.S. Pat. No. 8,347,772 which is a continuation in part of U.S. patent application Ser. No. 12/348,601, filed Jan. 5, 2009, now U.S. Pat. No. 7,908,956, where application Ser. No. 13/034,053 claims the benefit of U.S. Provisional Patent Application Nos. 61/368,417, filed Jul. 28, 2010, and 61/413,034, filed Nov. 12, 2010; and application Ser. No. 12/348,601 claims the benefit of U.S. Provisional Patent Application No. 61/019,694 filed Jan. 8, 2008, all of the above applications being expressly incorporated by reference herein in their entireties.

FIELD OF THE INVENTION

The present disclosure relates to tubular braiding transitioning to flat braiding transitioning to tubular braiding with added reinforcing material.

BACKGROUND

Braided suture tapes are used in orthopedic procedures such as hip and shoulder reconstructions, achilles tendon, rotator cuff and patellar tendon repair. Current technology for creating suture tapes, reference U.S. Pat. No. 7,892,256, which is incorporated by reference herein in its entirety, includes manual assembly processes, which are typically slow and difficult to repeat accurately.

SUMMARY

Figure 1A:
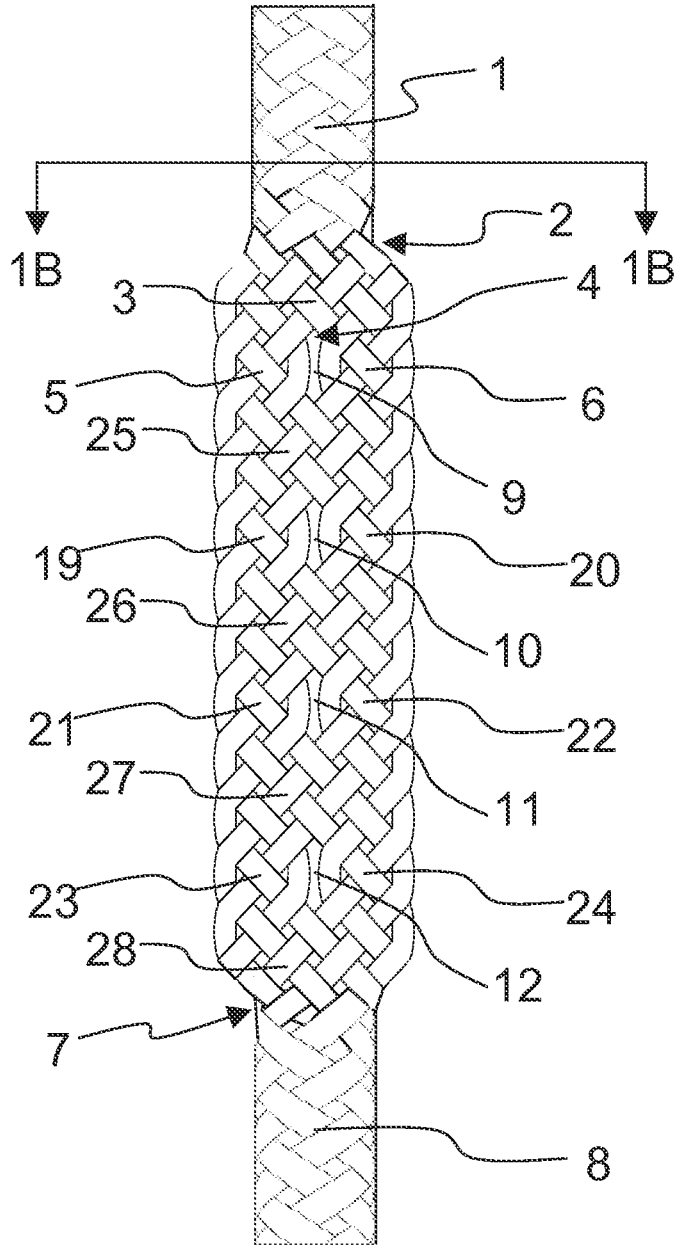
FIG. 1A and 1B are a top and front view schematic diagram of an 8-end braided tubular braid, an 8-end flat bifurcated braid and an 8-end tubular braid.

In some embodiments, a method comprises (a) operating a braider in a first braiding mode to provide a first braid section having a single flat braid or a single tubular braid; (b) operating the braider in a second braiding mode to provide a second braid section having at least two flat braids with a gap therebetween, the second braid section being continuous with the first braid section, wherein steps (a) and (b) are performed alternately to form a continuous braid having a plurality of first braid sections and one or more second braid sections alternating with each other; and (c) passing a length of material through the respective gap of one or more of the second braid sections, so the length of material crosses one or more times between a first side of the continuous braid and a second side of the continuous braid.

In some embodiments, a method comprises (a) operating a braider in a first operating mode to provide a first braid section having a single tubular braid; (b) operating the braider in a second braiding mode to provide a second braid section having a single flat braid adjacent the single tubular braid, the second braid section being continuous with the first braid section,; (c) operating the braider in a third braiding mode to provide a third braid section adjacent the second braid section, the third braid section having at least two flat braids with a gap therebetween, the third braid section being continuous with the second braid section, wherein steps (b) and (c) are performed alternately to form a continuous braid having a plurality of second braid sections and one or more third braid sections alternating with each other; (d) passing a length of material through a longitudinal tubular opening of the tubular braid and (f) passing the length of material through the respective gap of one or more of the third braid sections, so the length of material crosses one or more times between a first side of the continuous braid and a second side of the continuous braid.

In some embodiments, a continuous braid structure has one or more first braid sections, each having a respective single flat braid or a respective single tubular braid. A plurality of second braid sections each have at least two flat braids with a gap between them. The second braid sections alternate with the one or more first braid sections. The adjacent first and second braid sections are continuous with each other. A length of material extends through the respective gap of at least one of the one or more second braid sections, so the length of material crosses one or more times between a first side of the continuous braid and a second side of the continuous braid.

DETAILED DESCRIPTION

This description of the exemplary embodiments is intended to be read in connection with the accompanying drawings, which are to be considered part of the entire written description. In the description, relative terms such as "lower", "upper", "horizontal", "vertical", "above", "below", "up", "down", "top" and "bottom" as well as derivative thereof (e.g., "horizontally", "downwardly", "upwardly", etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected" refer to a relationship wherein structures are secured or attached to one another either directly or indirectly through intervening structures, as well as both movable or rigid attachments or relationships, unless expressly described otherwise.

This disclosure provides a suture tape construct, which can be automatically manufactured and dimensionally and structurally repeatable.

A structure and application of materials is disclosed herein, using braiding technology that braids from base tubular constructions into flat constructions and return to a tubular constructions with reinforcing material incorporated into the constructions.

Figure 1B:
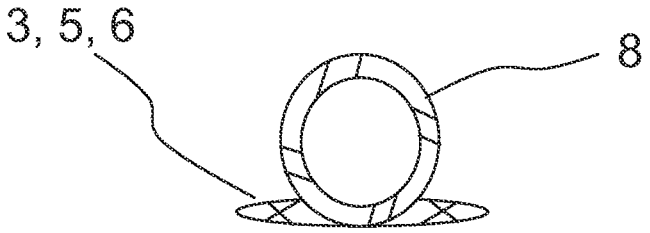

In one embodiment, FIG. 1 shows a schematic of an 8-end tubular braid (1) in a 1 over 1 construction. At transition point (2) the tubular braid transitions to an 8-end flat braid (3) in a 1 over 1 construction. At transition point (4) the 8-end flat braid transitions to two 4-end flat braids (5), (6) in a 1 over 1 construction. This pattern is continued for as long as desired until transition point (7) when the 8-end flat braid transitions back to an 8-end tubular braid (8). This is accomplished using the method as described in U.S. patent application Ser. No. 13/034,053, now U.S. Pat. No. 8,347,772 ("the '772 patent), which is incorporated by reference herein in its entirety. As described in the '772 patent, bobbin carriers are positioned on horngears having hornplates in a first fiat braiding mode, with the track and horngears configured so that the hornplates cause the bobbin carriers to move along at least one closed path that does not intersect any other closed path traveled by bobbin carriers. In FIG. 1 the transitions between one 8-end flat braid to two 4-end flat braids total nine giving five sections of one 8-end flat braid and four sections of two 4-end flat braids. The gap between the two 4-end flat braids creates openings (9), (10), (11), (12) in the 8-end flat braid.

Figure 2A:
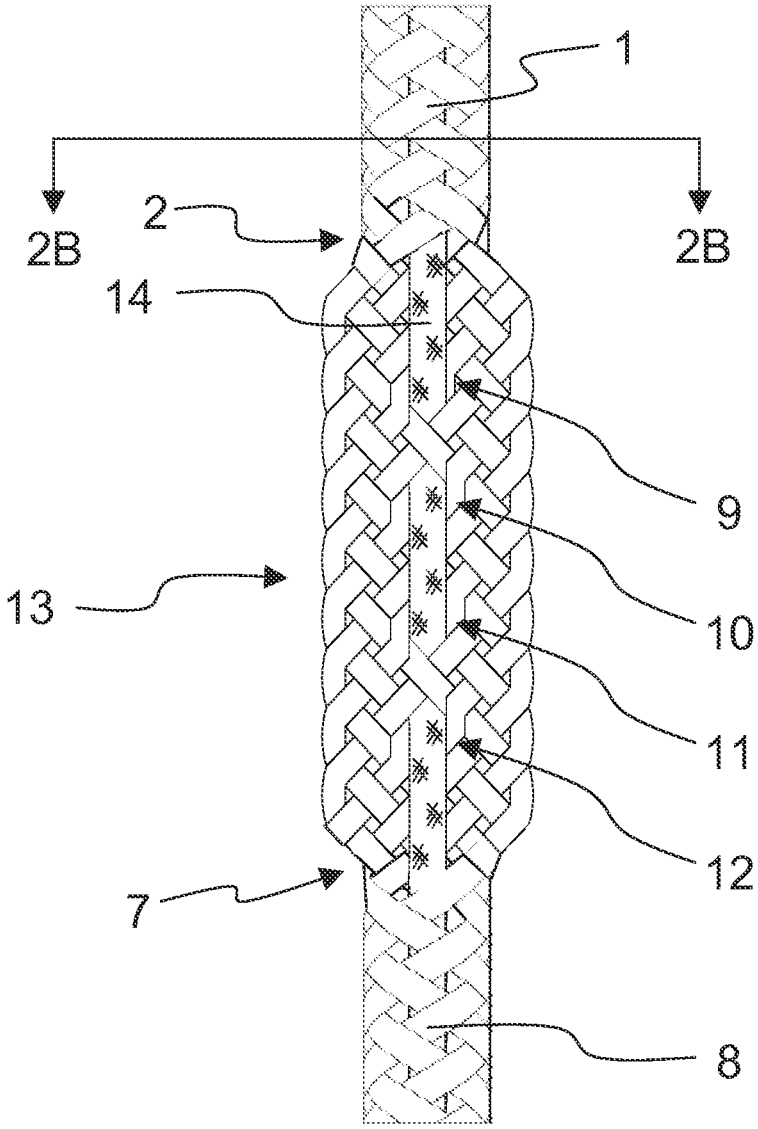
FIG. 2A and 2B are a top and front view schematic diagram of 8-end braided tubular braid, an 8-end flat braid and an 8-end tubular braid with material inserted.
Figure 2B:
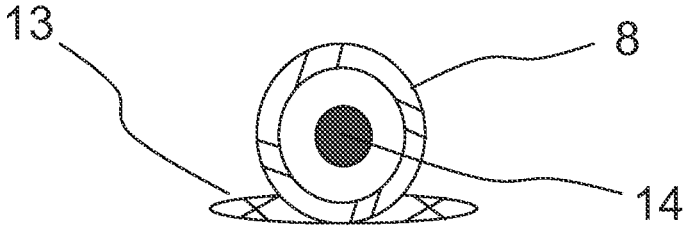
Figure 3:
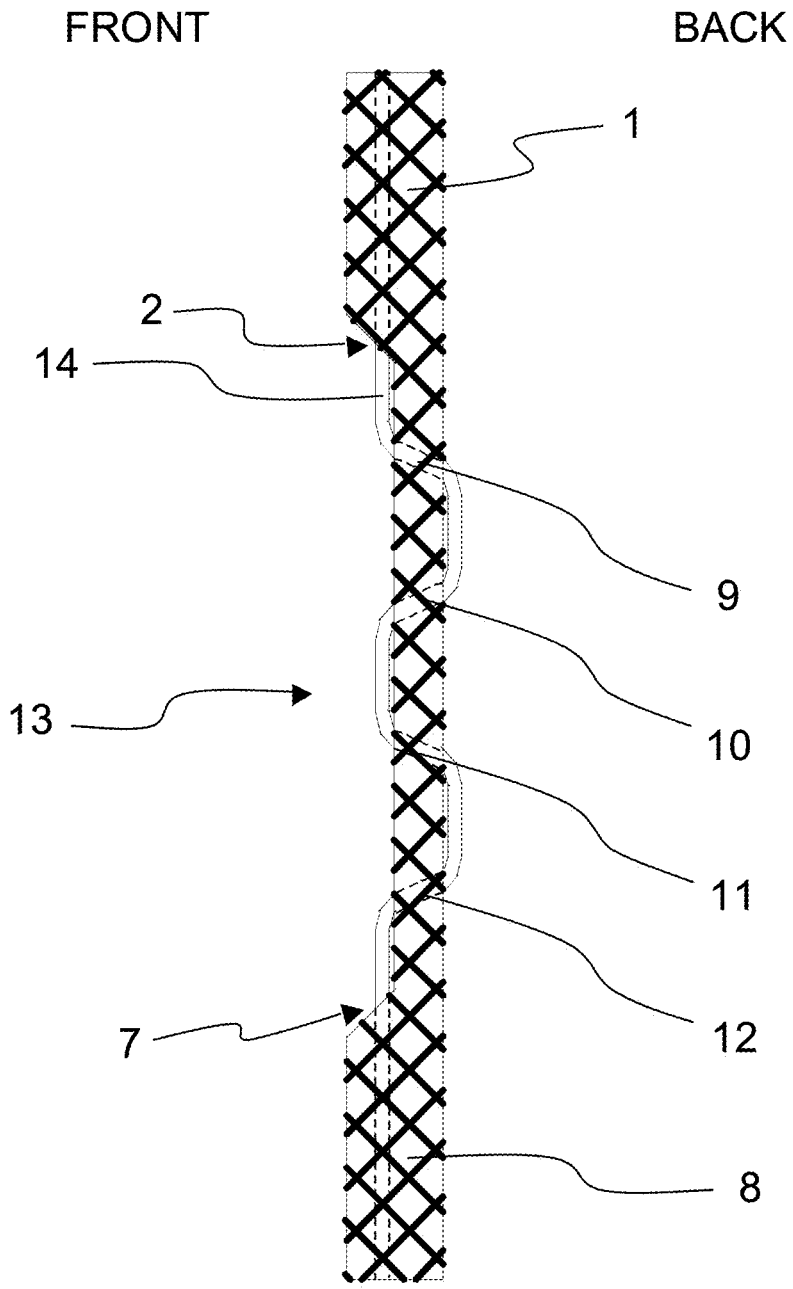
FIG. 3 is a side view schematic diagram of 8-end braided tubular braid, an 8-end flat braid and an 8-end tubular braid with material inserted.

FIG. 2 and FIG. 3 are a front and side view showing a schematic of an 8-end tubular braid (1) transitioning to 8-end and 4-end flat braids (13) transitioning to an 8-end tubular braid (8). A material (14) is included in the tubular sections (1), (8). The tubular sections (1), (8), may be formed using standard braiding techniques, for example, to which the yarn of additional material (14) is added. In some embodiments, the material (14) is the same type of yarn as is used to form the 8-end tubular braid (1) and 8-end and 4-end flat braid sections (13). In other embodiments, the material (14) can be a yarn of the same material type having a greater density (tex) than the yarn of the tubular braid (1). In other embodiments, the material (14) can be a yarn having at least one attribute different from the corresponding attribute of the yarn of the tubular braid (1) (e.g., higher modulus of elasticity).

The material (14) exits from the 8-end tubular braid (1) at transition point (2). During flat braiding, as described in U.S. patent application Ser. No. 13/034,053, when the two 4-end flat braid adjacent selvages are not being interwoven (and therefore a gap is formed), the material (14) can be passed from one side of the braiding machine to the other. The passing of the material (14) can be accomplished by a number of mechanical methods such as, but not limited to, a shuttle mechanism, a robotic arm, a pick and place mechanism, or the like.

When the two 4-end flat braids are brought together and the adjacent selvages are interwoven the material (14) is trapped. Therefore at gap opening (9) the material (14) passes to the back of the flat braid. At gap opening (10) the material (14) passes to the front of the flat braid. At gap opening (11) the material (14) passes to the back of the flat braid. At gap opening (12) the material (14) passes to the front of the flat braid. The material (14) enters the 8-end tubular braid (8) at transition point (7). When the braid is under tension, the tubular braid collapses around the material (14) trapping it and keeping it from slipping creating the reinforcing spine.

Figure 5:
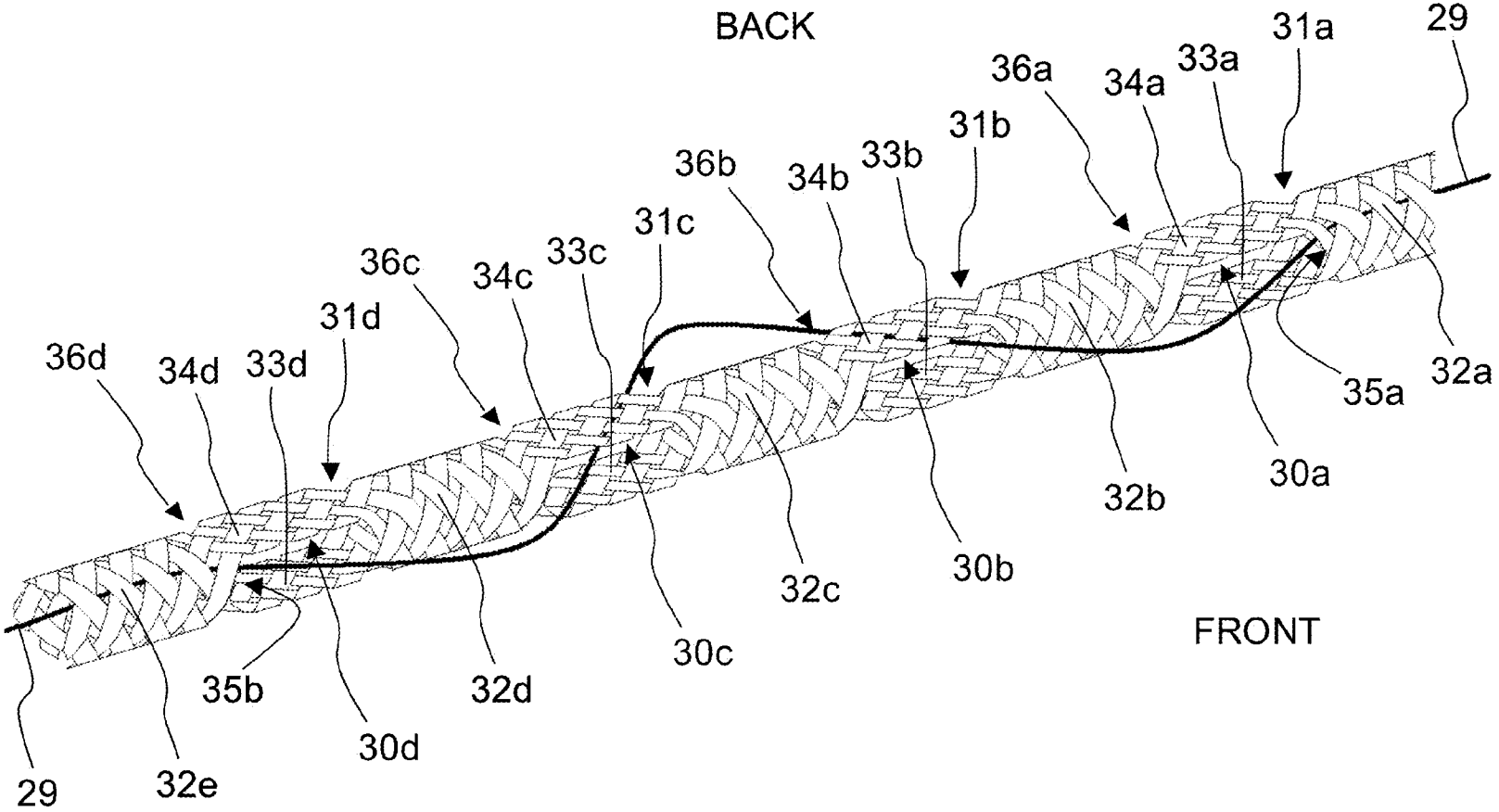
FIG. 5 is an isometric schematic of 8-end tubular braids transitioning to two 4-end bifurcated flat braids with internal material inserted.

In another embodiment, FIG. 5 shows a schematic of an 8-end tubular braid (32*a*) in a 1 over 1 construction braided over material (29). At transition point (31*a*) the tubular braid (32*a*) changes to two 4-end flat braids (33*a*), (34*a*) creating bifurcation (30*a*) and exposing the tubular braid inner core passageway opening (35*a*) allowing the material (29) to be pulled to the front side. At transition point (36*a*) the two 4-end flat braids (33*a*), (34*a*) change to an 8-end tubular braid (32*b*).

At transition point (31*b*) the tubular braid (32*b*) changes to two 4-end flat braids (33*b*), (34*b*) creating bifurcation (30*b*) allowing the material (29) to be pulled to the back side.

At transition point (36*b*) the two 4-end flat braids (33*b*), (34*b*) change to an 8-end tubular braid (32*c*).

At transition point (31*c*) the tubular braid (32*c*) changes to two 4-end flat braids (33*c*), (34*c*) creating bifurcation (30*c*) allowing the material (29) to be pulled to the front side.

At transition point (36*c*) the two 4-end flat braids (33*c*), (34*c*) change to an 8-end tubular braid (32*d*).

At transition point (31*d*) the tubular braid (32*d*) changes to two 4-end flat braids (33*d*), (34*d*) creating bifurcation (30*d*) and exposing the tubular braid inner core passageway opening (35*b*) allowing material (29) to reinserted and the 8-end tubular braid (32*e*) to be braided over material (29).

This process can be executed for as few as two bifurcations or as many as desired. In addition, the lengths of the tubular braids and bifurcation braids can be as long or short as desired and do not have to be equal lengths. If appropriate, tubular and/or bifurcation braids can be skipped.

Figure 6:
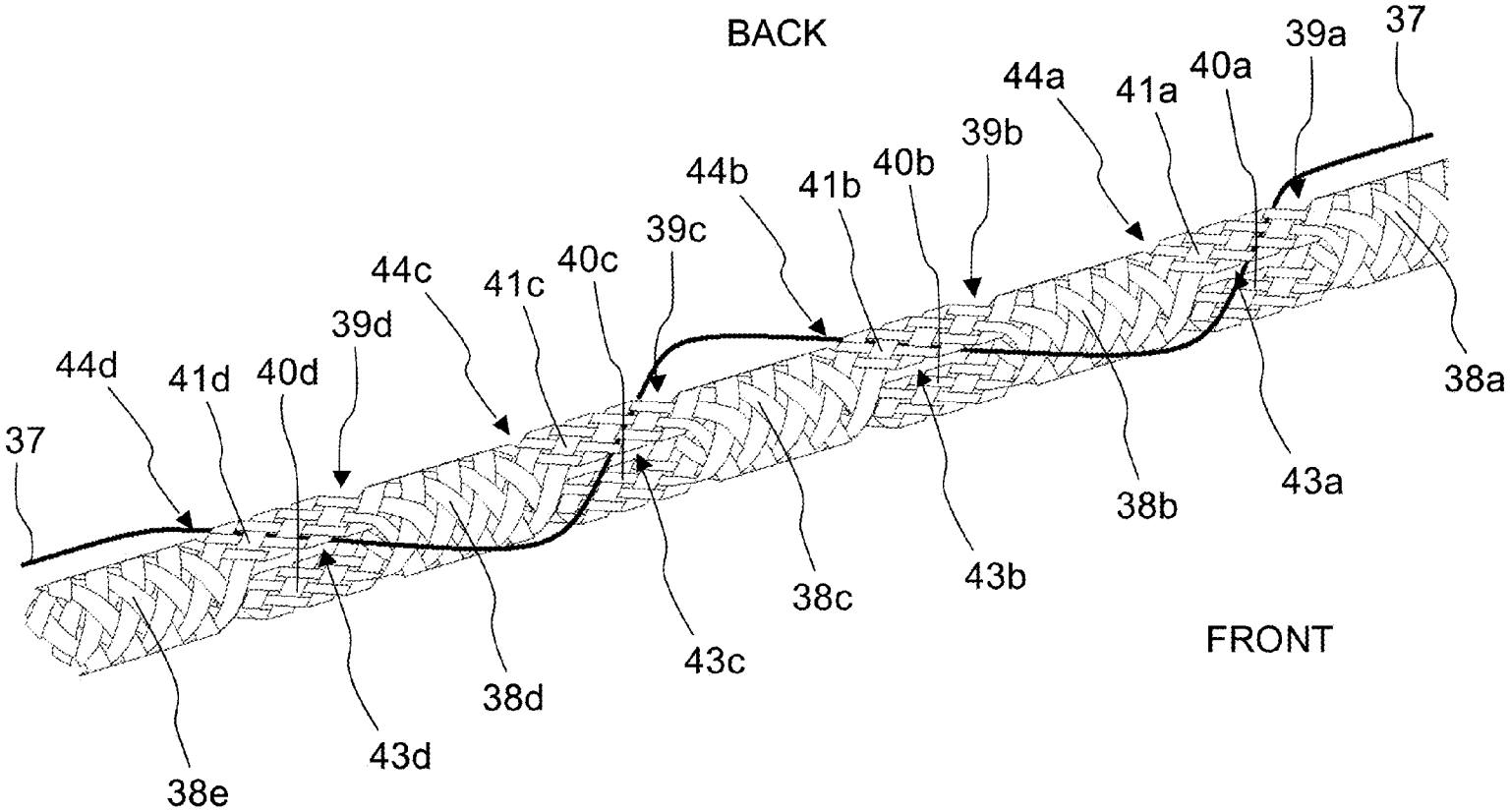
FIG. 6 is an isometric schematic of 8-end tubular braids transitioning to two 4-end bifurcated flat braids with external material inserted.

In another embodiment, FIG. 6 shows a schematic of an 8-end tubular braid (38*a*) in a 1 over 1 construction with external material (37). At transition point (39*a*) the tubular braid (38*a*) changes to two 4-end flat braids (40*a*), (41*a*) creating bifurcation (43*a*) allowing the material (37) to be pulled to the front side. At transition point (44*a*) the two 4-end flat braids (40*a*), (41*a*) change to an 8-end tubular braid (38*b*).

At transition point (39*b*) the tubular braid (38*b*) changes to two 4-end flat braids (40*b*), (41*b*) creating bifurcation (43*b*) allowing the material (37) to be pulled to the back side.

At transition point (44*b*) the two 4-end flat braids (40*b*), (41*b*) change to an 8-end tubular braid (38*c*).

At transition point (39*c*) the tubular braid (38*c*) changes to two 4-end flat braids (40*c*), (41*c*) creating bifurcation (43*c*) allowing the material (37) to be pulled to the front side.

At transition point (44*c*) the two 4-end flat braids (40*c*), (41*c*) change to an 8-end tubular braid (38*d*).

At transition point (39*d*) the tubular braid (38*d*) changes to two 4-end flat braids (40*d*), (41*d*) creating bifurcation (43*d*) allowing material (37) to be pulled to the back side.

This process can be executed for as little as one bifurcation or as many as required. In addition, the lengths of the tubular braids and bifurcation braids can be as long or short as required and do not have to be equal lengths. If needed tubular and/or bifurcation braids can be skipped.

Any combinations of these configurations can be created by controlling when tubular, bifurcations and/or flats are braided along with the movement of the external material.

Figure 4A:
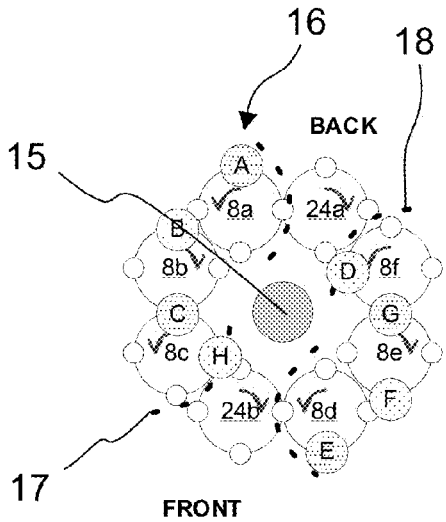
FIG. 4*a*-4*q* are flow schematics showing the individual steps in the process.
Figure 4B:
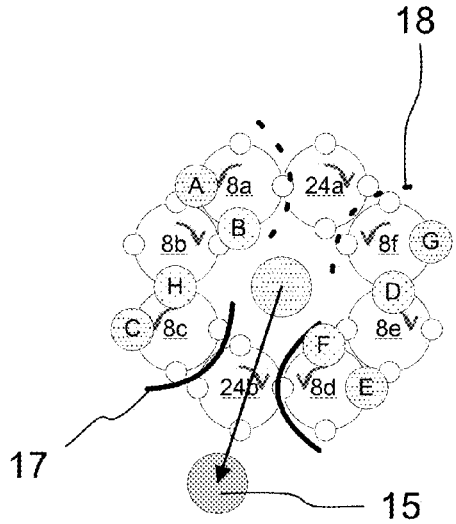
Figure 4C:
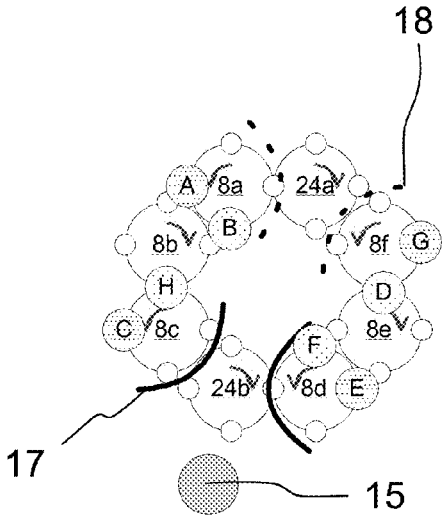
Figure 4D:
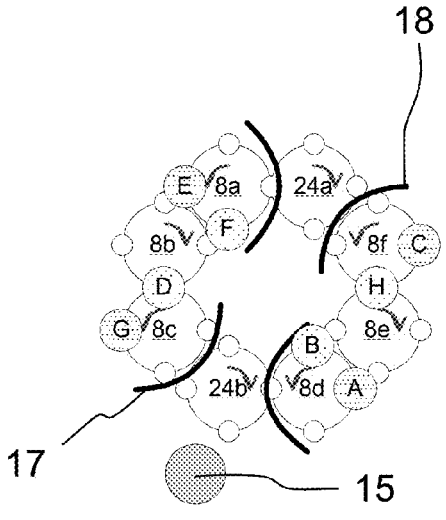
Figure 4E:
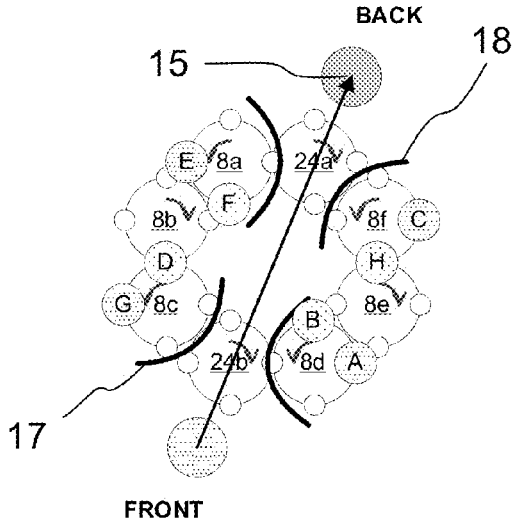
Figure 4F:
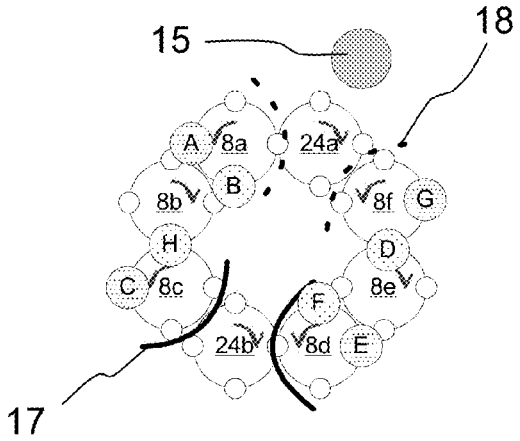
Figure 4G:
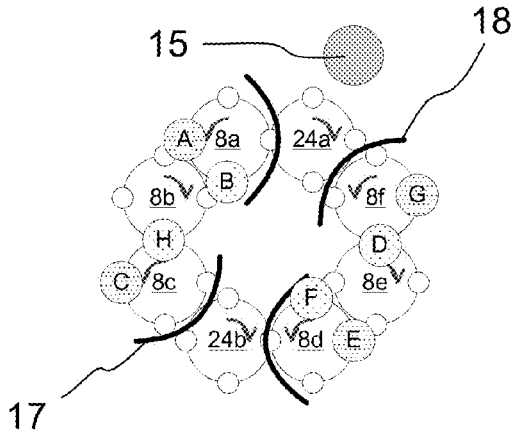
Figure 4H:
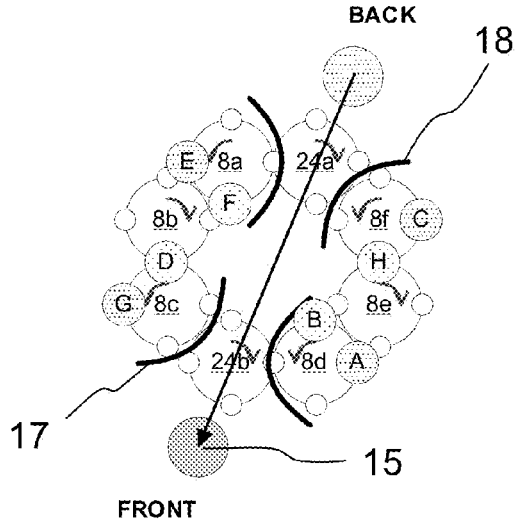
Figure 4I:
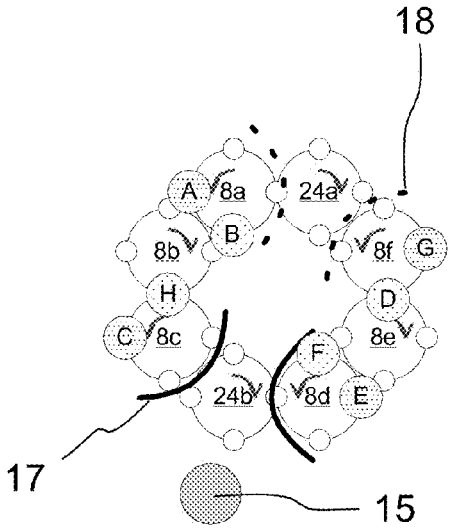
Figure 4J:
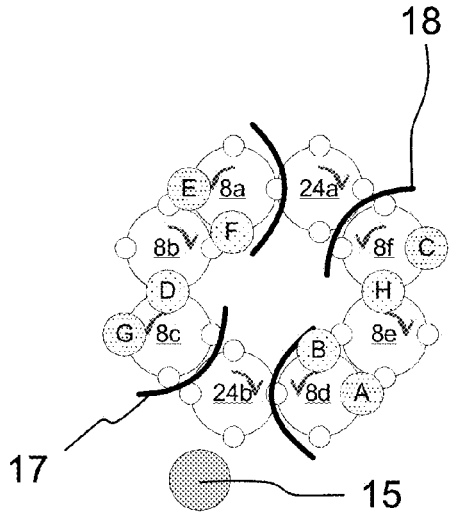
Figure 4K:
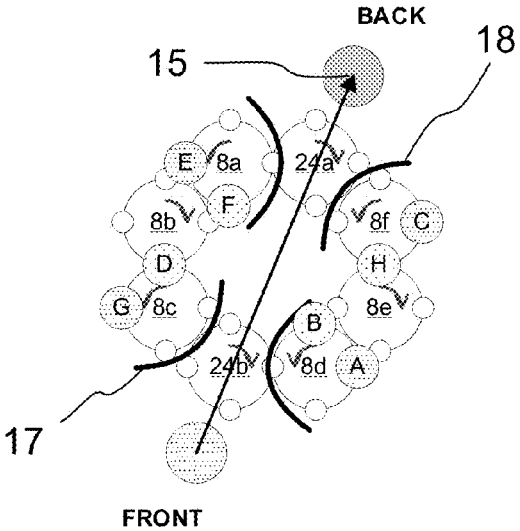
Figure 4L:
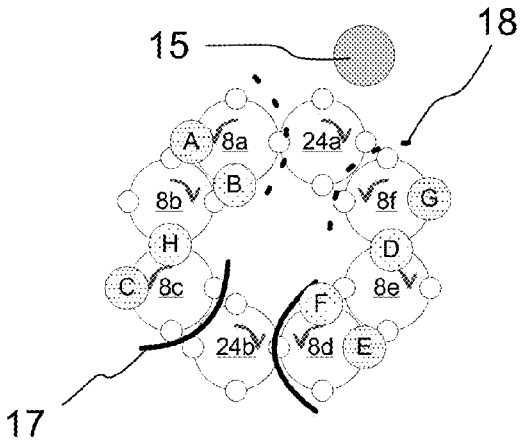
Figure 4M:
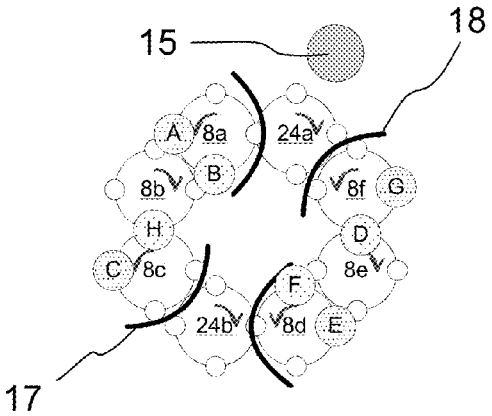
Figure 4N:
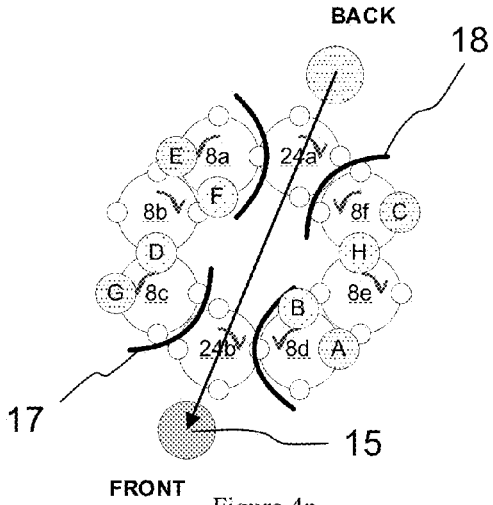
Figure 4O:
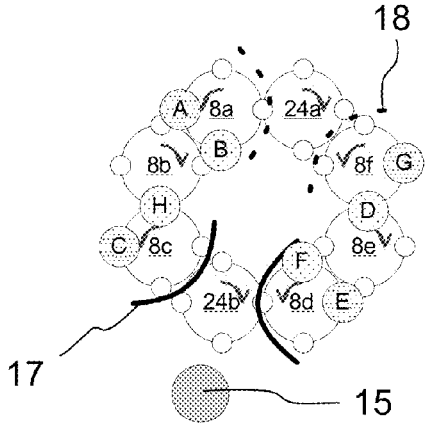
Figure 4P:
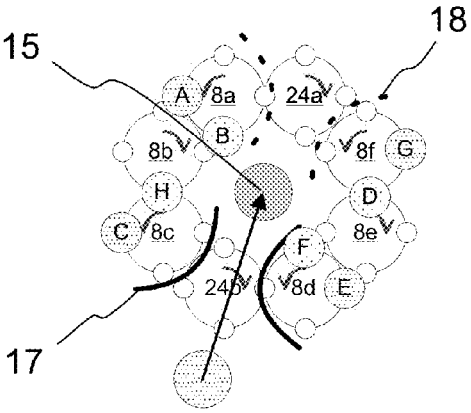
Figure 4Q:
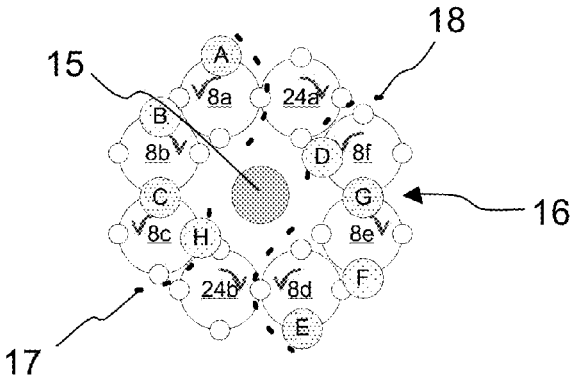

FIG. 4*a*-4*q* shows the steps in the process for braiding a tube to flat to tube with an included spine of material (14). FIG. 1,2 features are referenced. In FIGS. 4*a*-4*q*, the horngears 8*a*-8*f* and 24*a*-24*b* of the braiding machine are shown schematically using the same convention as in U.S. patent application Ser. No. 13/034,053, incorporated by reference herein in its entirety. Details of the braiding machine, and use of the bifurcation gates are not repeated herein.

FIG. 4*a* shows the position of the material supply (15) in its position in relation to the braiding carriers (16) for the tubular portion (1), (8) of the process. The orientation, FRONT and BACK, represents that of FIG. 3. In the FIG. 4*a* position the carriers braid around the outside of the material. Neither of the bifurcation gates (17), (18) are activated. The tubular braid can be as long as appropriate for a given application or specification.

In FIG. 4*b* the carriers have reached the bifurcation position with one set of bifurcation gates (17) activated and the second set of bifurcation gates (18) inactivated, the material supply (15) moves out of the braid area. This corresponds to transition point (2).

FIG. 4*c* is the configuration for 8-end flat braiding. The braiding carriers (16) travel in the closed path to create the 8-end flat braid (3) with the material in the front of the braid. The 8-end flat can be as long as desired.

FIG. 4*d* is the configuration for the two 4-end flat braids. The bifurcation gates (17), (18) activate and the two 4-end braids (5), (6) are braided creating the gap opening (9). The length of the gap opening is typically 1 to 2 picks but can be as long as desired.

In FIG. 4*e* the two 4-end flat braiding (5), (6) has completed with both sets of bifurcation gates (17), (18) activated. The material (15) is passed from the front to the back moving the material through the gap opening (9).

In FIG. 4*f* the carriers braid 8-end flat braid (25) with the material in the back of the braid. The braid (25) can be as long as desired.

In FIG. 4*g* the bifurcation gates (17), (18) are activated and the carriers braid two 4-end flat braids (19), (20) creating gap opening (10) typically 1 to 2 picks in length but can be as long as desired.

In FIG. 4*h* the two 4-end flat braiding (19), (20) has completed with both sets of bifurcation gates (17), (18) activated. The material (15) is passed from the back to the front moving the material through the gap opening (10).

In FIG. 4*i* the carriers braid 8-end flat braid (26) with the material in the front of the braid. The braid (26) can be as long as desired.

In FIG. 4*j* the bifurcation gates (17), (18) are activated and the carriers braid two 4-end flat braids (21), (22) creating gap opening (11) typically 1 to 2 picks but can be as long as desired.

In FIG. 4*k* the two 4-end flat braiding (21), (22) has completed with both sets of bifurcation gates (17), (18) activated. The material (15) is passed from the front to the back moving the material through the gap opening (11).

In FIG. 4*l* the carriers braid 8-end flat braid (27) with the material in the back of the braid. The braid (27) can be as long as desired.

In FIG. 4*m* the bifurcation gates (17), (18) are activated and the carriers braid two 4-end flat braids (23), (24) creating gap opening (12) typically 1 to 2 picks but can be as long as desired.

In FIG. 4*n* the two 4-end flat braiding (23), (24) has completed with both sets of bifurcation gates (17), (18) activated. The material (15) is passed from the front to the back moving the material through the gap opening (12).

In FIG. 4*o* the carriers braid 8-end flat braid (28) with the material (15) in the front of the braid. The braid (28) can be as long as desired.

In FIG. 4*p* the 8-end flat braid (28) has been completed and the material (15) is passed into the center of the carriers. This corresponds to transition point (7).

In FIG. 4*q* the carriers braid around the material (15) creating the tubular section (8).

For embodiments of FIGS. 2 and 6 the number of gaps, as long as it is an even number, and the length of the gaps and the tubular and flat braids is not limited. For embodiment of FIG. 6 the number of gaps can be either even or odd and the length of the gaps and the tubular and flat braids is not limited. The total number of ends for either the tubular or flat braids , as long as it is divisible by 4, are also not limited. The material can be any material with the property of being able to be braided such as, but not limited to, nylon, high tenacity polyester, fiberglass, carbon, wire, Poly-paraphenylene terephthalamide (such as, e.g., "KEVLAR®" para-aramid fibers sold by E. I. du Pont de Nemours and Company of Wilmington, Del., or Ultra-high-molecular-weight polyethylene (UHMWPE, UHMW), such as "DYNEEMA®" fibers sold by Koninklijke DSM N.V., Heerlen, the Netherlands.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method comprising:

(a) operating a braider in a first braiding mode to provide a first braid section having a single flat braid or a single tubular braid;

(b) operating the braider in a second braiding mode, wherein a first plurality of bobbin carriers of the braider move along at least one closed path that does not intersect any other closed path through which a second plurality of bobbin carriers of the braider move, to provide a second braid section having at least two flat braids with a gap therebetween, the second braid section being continuous with the first braid section, wherein steps (a) and (b) are performed alternately to form a continuous braid having a plurality of first braid sections and one or more second braid sections alternating with each other; and (c) passing a length of material through the respective gap of one or more of the second braid sections, so the length of material crosses one or more times between a first side of the continuous braid and a second side of the continuous braid.

2. The method of claim 1, wherein step (c) is performed using one of the group consisting of a shuttle, a robotic arm or a pick and place mechanism.

3. The method of claim 1, wherein each first braid section has a single flat braid, further comprising:

(d) operating the braider in a third operating mode to provide a third braid section having a single tubular braid adjacent to at least one of the plurality of first braid sections; and (e) passing the length of material through a longitudinal tubular opening of the tubular braid.

4. The method of claim 3, wherein steps (d) and (e) are performed to provide a third braid section at each respective end of the continuous braid.

5. The method of claim 4, wherein:

the continuous braid has at least three first braid sections and at least two second braid sections, and the length of material is passed through the respective gap of each of the second braid sections and the respective longitudinal tubular opening of each of the third braid sections.

6. The method of claim 1, wherein:

each of the first braid sections has a tubular braid having a respective longitudinal tubular opening, the length of material is passed through the respective longitudinal tubular opening of one of the first braid sections at a first end of the continuous braid and one of the first braid sections at a second end of the continuous braid opposite the first end, and the length of material is passed through the respective gap of two or more of the second braid sections.

7. The method of claim 1, wherein the first braid section and second braid section comprise a first material, and the length of material comprises a second material different from the first material.

8. The method of claim 7, wherein the second material has a higher modulus of elasticity than the first material.

9. The method of claim 7, wherein the second material has a higher density than the first material.

10. The method of claim 7, wherein the second material is one of the group consisting of nylon, polyester, fiber glass, and carbon.

11. The method of claim 7, wherein the second material is a wire.

12. The method of claim 1, wherein step (c) is performed while the braider is in the second braiding mode

13. The method of claim 1, wherein:

step (a) includes operating the braider with a plurality of bobbin carriers positioned on a plurality of horngears in a first flat braiding mode, to cause each bobbin carrier to move along a respective first closed path that does not intersect a respective first closed path of any other bobbin carrier, and step (b) includes operating the braider with the plurality of bobbin carriers positioned on the plurality of horngears in a second flat braiding mode, to cause each bobbin carrier to move along a respective second closed path that does not intersect a respective second closed path of any other bobbin carrier, wherein the second closed paths are different from the first closed paths.

14. The method of claim 13, wherein the braider is changed from the first flat braiding mode to the second flat braiding mode by activating a plurality of bifurcation gates.

15. A method comprising:

(a) operating a braider in a first operating mode to provide a first braid section having a single tubular braid;

(b) operating the braider in a second braiding mode to provide a second braid section having a single flat braid adjacent the single tubular braid, the second braid section being continuous with the first braid section;

(c) operating the braider in a third braiding mode to provide a third braid section adjacent the second braid section, the third braid section having at least two flat braids with a gap therebetween, the third braid section being continuous with the second braid section, wherein steps (b) and (c) are performed alternately to form a continuous braid having a plurality of second braid sections and one or more third braid sections alternating with each other;

(d) passing a length of material through a longitudinal tubular opening of the tubular braid and (f) passing the length of material through the respective gap of one or more of the third braid sections, so the length of material crosses one or more times between a first side of the continuous braid and a second side of the continuous braid.

16. A continuous braid structure comprising:

one or more first braid sections, each having a respective single flat braid or a respective single tubular braid;

a plurality of second braid sections, each having at least two flat braids with a gap therebetween, each of the at least two flat braids having a configuration formed by moving a first plurality of bobbin carriers of a braider along at least one closed path that does not intersect any other closed path through which a second plurality of bobbin carriers of the braider move, wherein the second braid sections alternate with the one or more first braid sections, the adjacent first and second braid sections being continuous with each other; and a length of material extending through the respective gap of at least one of the one or more second braid sections, so the length of material crosses one or more times between a first side of the continuous braid and a second side of the continuous braid.

17. The structure of claim 16, wherein each first braid section has a single flat braid, the structure further comprising:

a respective single tubular braid at each respective end of the braid structure.

18. The structure of claim 17, wherein the length of material extends through each single tubular braid.

19. The structure of claim 16, wherein the first braid section and second braid section comprise a first material, and the length of material comprises a second material having a higher modulus of elasticity than the first material.

20. The structure of claim 19, wherein the second material is one of the group consisting of nylon, polyester, fiber glass, and carbon.

21. The structure of claim 16, wherein each of the at least two flat braids has a single layer of yarns.

* * * * *